US005887704A

United States Patent [19]

Schorpp et al.

[11] Patent Number: 5,887,704

[45] Date of Patent: Mar. 30, 1999

[54] SWITCHING ARRANGEMENT FOR A MOTOR VEHICLE CONTROL PANEL

[75] Inventors: Kurt Schorpp, Tuttlingen; Siegfried Klink, Schoenaich; Uwe Manzke, Weil der Stadt; Van-Hung Nguyen, Sindelfingen, all of Germany

[73] Assignee: Daimler-Benz AG

[21] Appl. No.: 975,034

[22] Filed: Nov. 20, 1997

[30] Foreign Application Priority Data

Nov. 20, 1996 [DE] Germany ..... 196 47 946.0

[51] Int. Cl.[6] ..... H01H 9/02

[52] U.S. Cl. ..... 200/296; 200/58

[58] Field of Search ..... 200/5 R, 5 A, 200/18, 293–296, 302.1–303, 307, 333; 400/472, 488–490, 492, 495

[56] References Cited

U.S. PATENT DOCUMENTS 4,467,150 8/1984 Leitermann et al. ..... 200/5 A
5,174,621 12/1992 Anderson ..... 296/70
5,243,156 9/1993 Shirasaka ..... 200/5 R
5,553,953 9/1996 Herman et al. ..... 400/489
5,610,602 3/1997 Hargreaves ..... 341/22
5,739,486 4/1998 Buckingham ..... 200/5 A

FOREIGN PATENT DOCUMENTS 43 38 829 A1 of 1995 Germany ..... H01H 3/02

*Primary Examiner*—Michael A. Friedhofer
*Attorney, Agent, or Firm*—Evenson, McKeown, Edwards & Lenahan, P.L.L.C.

[57] ABSTRACT

A switch arrangement for a control panel placed on the dashboard or a central console in a motor vehicle. The switch arrangement comprises a housing for at least one switch having an actuating element. The switch is located in a receptacle in the housing. A mask whose contour has a curvature and a recess can be mounted on the housing, through which recess an actuating element of the switch projects after the mask has been applied. The housing has at least two housing parts, with each housing part being associated with an area of mask. The side of housing parts associated with the mask is arranged approximately parallel to a plane surface that follows the curvature of corresponding areas of the mask.

15 Claims, 6 Drawing Sheets

SWITCHING ARRANGEMENT FOR A MOTOR VEHICLE CONTROL PANEL

BACKGROUND AND SUMMARY OF THE INVENTION

This application claims the priority of German patent document no. 196 47 946.0, the disclosure of which is expressly incorporated by reference herein.

The invention relates to a switch arrangement for a motor vehicle control panel. Such control panels may be located, for example, in the dashboard or center console of the vehicle.

A switch arrangement for a control panel on the dashboard, center console or the like in a motor vehicle is disclosed in German patent document DE-OS 43 38 829. This switch arrangement has a housing with receptacles for electrical switches, each of which has an actuating element as a handle for the user. A flat mask can be mounted on the housing to seal off the control panel. The mask has recesses corresponding to the actuating elements, through which recesses the respective actuating elements of the switches project after the mask is applied. The actuating element of the switch is mounted displaceably with respect to the housing so that when the mask is applied, the actuating element is automatically centered in the recess in the mask.

With this switch arrangement, manufacturing tolerances occur essentially in a plane parallel to the mask, and are compensated by the displaceability of the actuating element in the housing. To improve the ergonomic aspects for the user, domed control panels have recently come into increasing use. When the switch is located in a domed control panel, further gaps and/or differences in height between the individual actuating elements and the domed mask. There is nothing in the above publication, however, which indicates how such additional gaps and differences in height can be avoided when using a domed mask.

The object of the present invention is to provide an improved switch arrangement such that, when a domed mask is used, different gaps and heights of the actuating elements in the recesses of the mask are avoided.

This and other objects and advantages are achieved by the switch arrangement according to the invention, in which the switches are divided into a plurality of partial arrangements. Each partial arrangement is associated with a housing part, which together with the switches, occupies a position when the mask is applied such that the housing part is essentially parallel to a flat surface that approximates the curvature of the mask. Additional embodiments of the invention are concerned in particular with improvements for automatic adjustment of the housing parts, as well as of the actuating elements of the switches to the mask contour when the mask is applied.

In order to assure ergonometrically favorable actuation for the user, the surface of the actuating element can extend approximately parallel to a surface that approximates the environment of the recess in the mask, with the contour of the mask having a curvature in a first direction that is approximately perpendicular to the surface of the actuating element. This first direction then simultaneously constitutes the assembly direction for the mounting of the mask on the housing. In addition, the contour of the mask can also have a curvature in a second direction that lies approximately at the surface of the actuating element and is approximately perpendicular to the first direction.

To facilitate the assembly of the switch arrangement, the housing parts can be located on the surface of a carrier part, which is then formed approximately parallel to a flat surface which approximates the area of the mask associated with the housing part. In addition, there is the opportunity that one of the additional housing parts and the carrier part can form a sort of basic body, with the carrier part being connected integrally with the other housing part.

To improve the compensation of tolerances that occur especially in extended switch arrangements, the housing parts are mounted to be displaceable relative to one another and/or to the carrier part and/or to the basic body. As a result, when the mask is applied, the housing parts are aligned approximately parallel to the approximating surface of the corresponding area for adaptation to the contour of the mask.

Displaceability of the housing is provided in at least one direction. This direction can be the first direction corresponding to the curvature of the mask, and/or the assembly direction for mounting the mask on the housing. Centering means are then provided on the mask, which act on the housing parts when the mask is applied to the housing for alignment.

In addition, displaceability of the housing part can be provided within a plane that runs parallel to the approximating plane surface corresponding to a curvature of the mask in the first direction. It is also possible to provide a floating mount for the housing part of the surface on the supporting part that receives the housing part. As a result, when the mask is applied, the housing part, is aligned with the actuating element located on the housing part by interaction with the recess in the mask. This alignment, which serves to further adapt to the contour of the mask, takes place approximately parallel to the approximating surface corresponding to the curvature of the mask in the second direction.

The displaceable mount can have the form of guides with corresponding play, which help the housing part and the supporting part to cooperate with one another. In addition, a spring-tensioned rib located on one of the two parts engages a recess on another of the two parts by means of a latching nose with corresponding play, and a fixed rib provided on one of the two parts engages a recess in the other of the two parts with corresponding play.

A displaceable mount of this kind achieves improved adjustment of the switch relative to the curvature of the mask when it is mounted, such adjustment taking place automatically during assembly. To avoid subsequent maladjustment, the housing parts are fixed in this position, with the housing parts being fastened to the mask after the mask is applied. Fastening can be performed by means of a screw connection, for example with threaded bushings being provided on the side of the mask that faces the housing parts and with mounting bolts projecting through the housing parts engaging the threaded bushings through elongate holes in the housing parts.

It is possible for a vehicle operator to evaluate the actuation of the switches in the switch arrangement. For this purpose, a printed circuit board is located in the housing part, on which board the required electronics, connectors for electrical leads, etc. are located. To simplify the preassembly of the printed circuit boards, it is also possible to locate thereon the switch modules that contain the contact system and are designed as pressure switches. The actuating element of the switch, designed in the form of a rocker switch in the circuit, then acts on the switch module to actuate the contact system, by cams for example. For this purpose, an opening is provided on the side of the housing part that faces the mask, so that the switch module is accessible to the actuating element.

In order to center the actuating element automatically in the recess in the mask as well, the actuating element can be rotatably mounted on a frame. The frame in turn is mounted displaceably, in the manner of a floating bearing, on the side of the housing part that faces the mask. By virtue of this floating mount, the frame with the recess acts in the mask to center the actuating element in the recess when the mask is applied.

For ergonomic reasons, it may be desirable for the contour of the mask to have curves that are symmetrical with respect to a central axis running through the housing. In this case, it is especially advantageous for the housing to consist of three housing parts, with the middle housing part preferably being integrated into the carrier part. Each of the two lateral housing parts is mounted displaceably on the carrier part. The switch located on the central axis is mounted nondisplaceably, so that this switch serves as a reference for aligning the two lateral housing parts as well as the other switches when the mask is applied.

The advantages achieved by the invention consist especially in the fact that even with a domed mask, tolerances between the actuating element and recesses in the domed mask can be compensated. As a result, it is possible to locate a plurality of switches on a common housing without incurring a high manufacturing cost. Since the actuating elements follow the curvature of the mask without any differences in height, the ergonomic aspects for the user are enhanced. Avoiding additional gaps also reduces the danger of dirt or other foreign matter penetrating the switch arrangement and adversely affecting its functional ability.

Other objects, advantages and novel features of the present invention will become apparent from the following detailed description of the invention when considered in conjunction with the accompanying drawings.

DETAILED DESCRIPTION OF THE DRAWINGS

Figure 1:
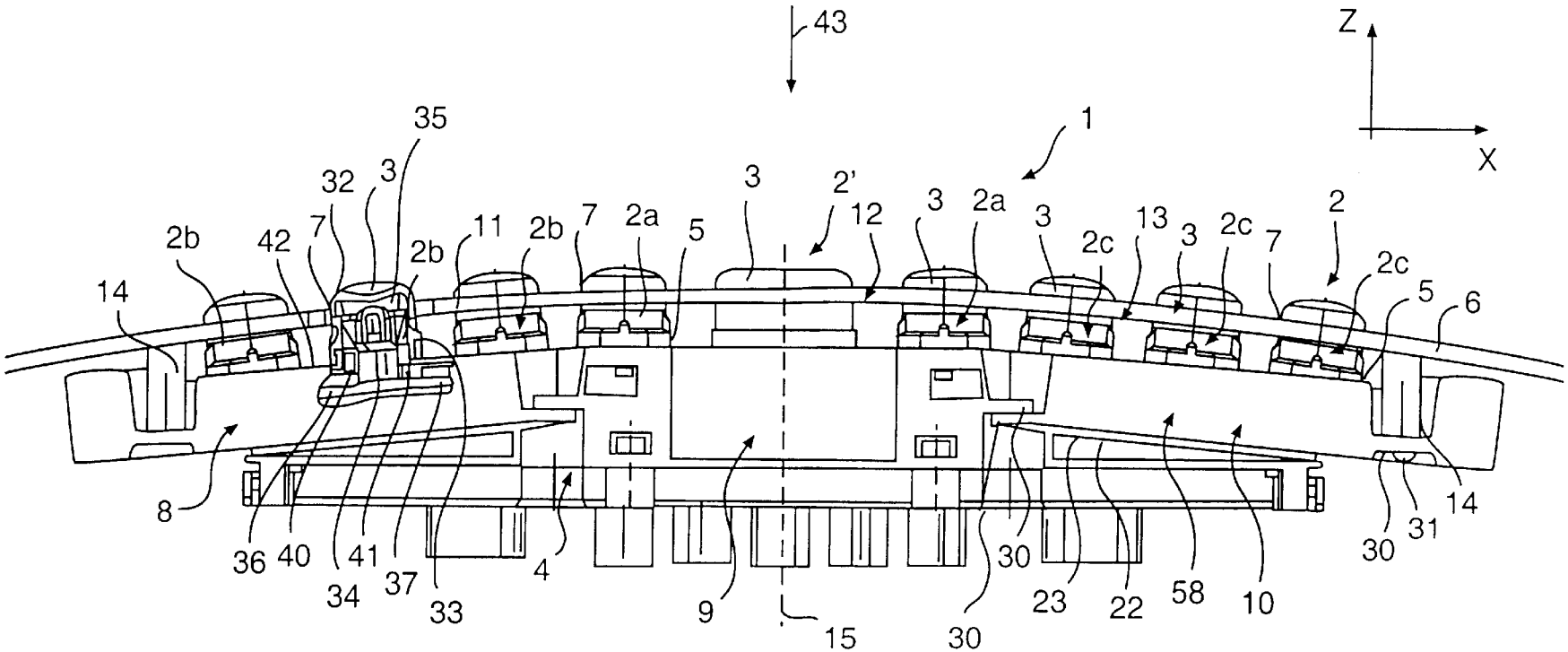
FIG. 1 is a side view of a switch arrangement.
Figure 2:
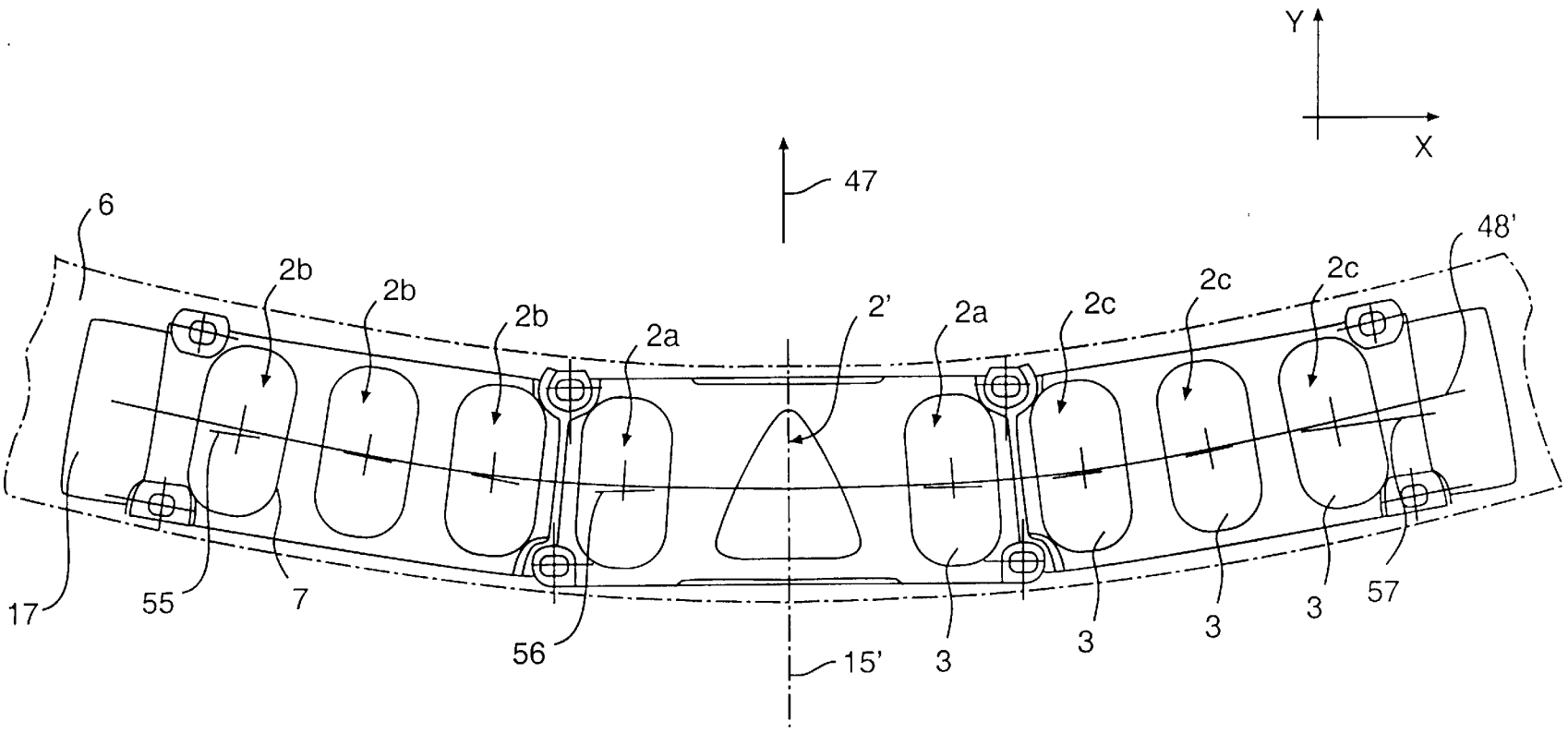
FIG. 2 is a top view of the switch arrangement viewed in the direction of arrow 43 in FIG. 1.

A switch arrangement 1 for a control panel on the dashboard of a motor vehicle is described in greater detail in FIGS. 1 and 2. A switch arrangement of this kind can also be provided for the center console, the arm rest on a door, or the like. Switch arrangement 1 has a plurality of electrical switches, located essentially side by side, said switches each being provided with a common reference number 2. Of course, electrooptical, optical or other switches can be provided instead of electrical switches.

Switches 2 can be arranged by groups corresponding to the functions they trigger in switch arrangement 1. In this case, there are three groups, a middle switch group 2*a* and switch groups 2*b* and 2*c* located on either side. The individual switches 2 can be operated by the user by means of actuating elements 3. As shown in FIG. 2, actuating elements 3 (seen in a top view) have an essentially rectangular elongated shape, with the exception of switch 2' in switch group 2*a*. Its actuating element 3 has an approximately triangular shape as viewed in a top view. Switch 2' is the switch for the flashers of the motor vehicle, and has an actuating element 3 that is different from the other switches 2 because of its special function. The other switches 2, for example, can be used to deploy the rear headrests, actuate the interior door locking system, operate the sliding roof, or the like. Because of the large number of switches 2 located in switch arrangement 1, the two outer switches 2 of switch groups 2*b* and 2*c* can be spaced approximately 20 to 30 cm or more apart.

As also indicated in FIG. 1, switches 2 in switch arrangement 1 are in a housing which in turn is mounted in the dashboard of the motor vehicle. Housing 4 has recesses 5 for switches 2. A mask 6 can be mounted on housing 4 to cover it. Mask 6 consists for example of a wood veneer panel on the visible side with a rear plastic panel attached to it, or a metal plate made of cast aluminum, cast magnesium, or the like. Following preassembly of switches 2 in housing 4, mask 6 is placed on housing 4, with the mounting direction preferably running essentially in a direction perpendicular to housing 4 as indicated by directional arrow 43, and is fastened to housing 4 by screws for example. Mask 6 is provided with recesses 7, made for example by milling them out with limited tolerances, to match the shape of actuating elements 3 of switches 2 preassembled in housing 4. Actuating elements 3 of switches 2 project through these recesses after mask 6 is mounted, as is shown especially clearly in the case of switch 2, shown sectioned in switch group 2*b* in FIG. 1.

For ergonomic and other reasons, mask 6 is made domed. For this purpose, the contour of mask 6 has a curvature which, as shown in FIG. 1, initially extends in one direction essentially corresponding to directional arrow 43 for middle switch group 2*a*. As is also evident from FIG. 1, the arrangement of the surfaces of actuating elements 3 essentially corresponds to that of the curvature of mask 6 running in the first direction. This is shown in FIG. 3, which shows middle switch group 2*a* as an enlarged section in FIG. 1.

Figure 3:
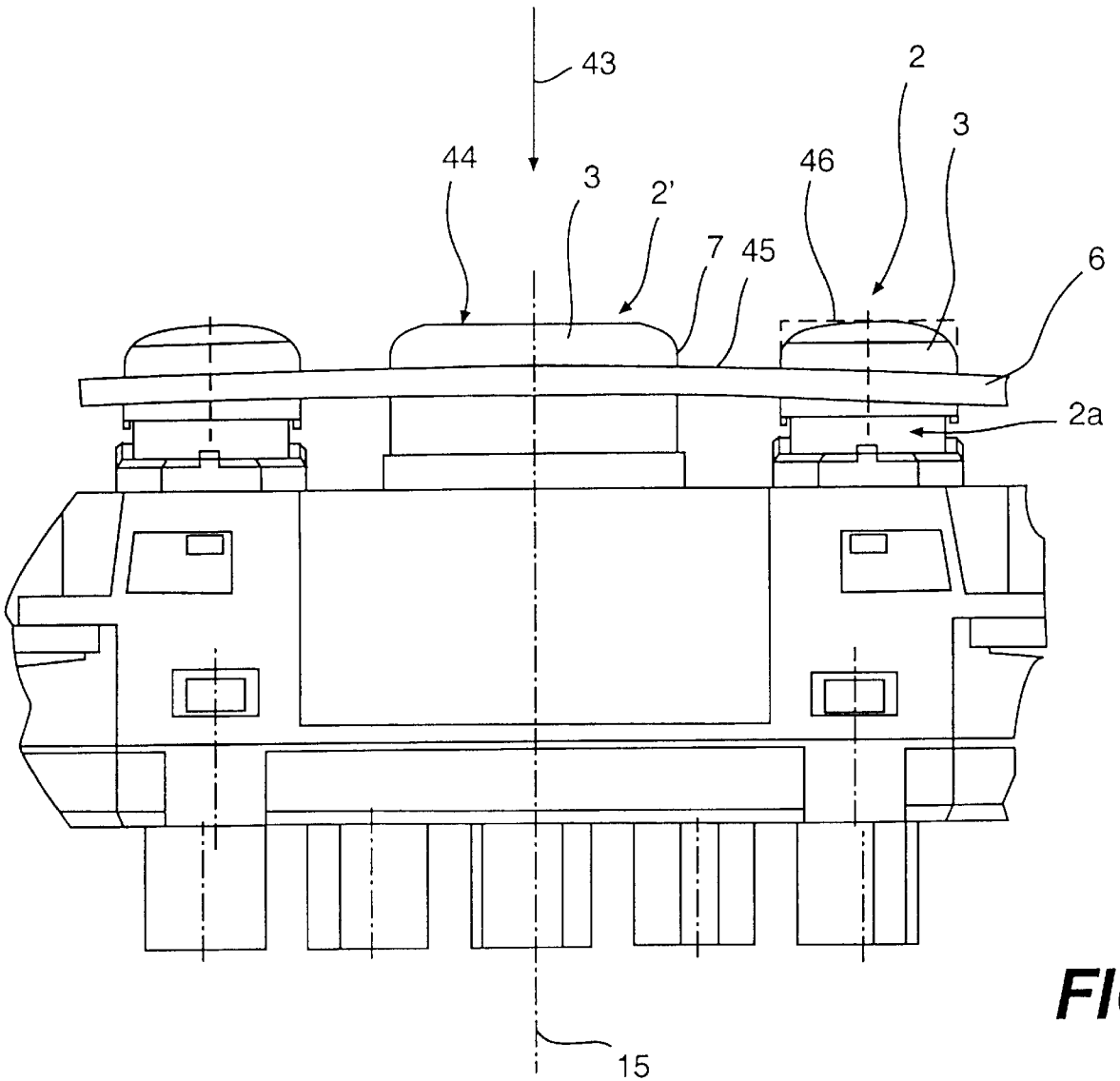
FIG. 3 shows the middle switch group enlarged in a section from FIG. 1.

As indicated in the case of switch 2' (FIG. 3), the curved environment of recess 7 can be approximated by a plane surface 45 (shown dashed in FIG. 3 for the sake of clarity). Surface 44 of actuating element 3 lies approximately parallel to this plane surface 45 that approximates the environment of recess 7 in mask 6. For ergonomic or other reasons, of course, the surface of actuating element 3 can be given a free-form surface, a gripping groove or the like for example, as shown at the right in FIG. 3, next to switch 2'. In this case, surface 46 enclosing the surface of actuating element 3 can be seen. As is also evident, the first direction corresponding to directional arrow 43, in which the contour of mask 6 has a curvature, is approximately perpendicular to surface 44, 46 of actuating element 3, so that the mounting direction for applying mask 6 to housing 4 also corresponds to the first direction.

Of course it is also possible for the contour of mask 6 to be curved in a direction different from the mounting direction. It is equally possible for the contour of mask 6 to have, in addition to the curvature in the first direction, an additional curvature in a second direction, in other words to be domed in two different directions. This is shown more clearly in FIG. 2 wherein the contour of mask 6 has a curvature in a second direction as indicated by directional arrow 47. As can be seen by comparing FIGS. 2 and 3, the second direction as indicated by directional arrow 47 lies approximately at surface 44, 46 of actuating element 3 and is also perpendicular to the first direction corresponding to directional arrow 43. As can also be seen from FIG. 2, the second direction is also perpendicular to the lengthwise direction of housing 4, said housing extending approximately parallel to the side-by-side arrangement of switches 2.

When such a domed mask 6 is mounted on housing 4, as a result of spacing and convexity tolerances, gaps or differences in height can develop between individual actuating elements 3 and recesses 7 as well as mask 6. To avoid such gaps or differences in height, housing 4 according to the invention is made of at least two housing parts. Of course, if necessary or advantageous, housing 4 can also consist of more than two housing parts.

As can be seen from FIGS. 1 and 2, in the present embodiment the contour of mask 6 has curvatures that are symmetrical relative to a middle axis 15, 15' that runs through housing 4 and especially through switch 2'. In this case, it is possible to make housing 4 out of three housing parts 8, 9, and 10 as can be seen in greater detail in FIG. 1. Each of housing parts 8, 9, and 10 comprises a switch group 2*a*, 2*b*, 2*c* and each has an area 11, 12, 13 of mask 6 associated with it. Housing part 9 of switch arrangement 1, for the sake of clarity, is located approximately in the x and y directions of a Cartesian system of coordinates so that the mounting direction of mask 6 lies in the z direction. As can be seen in greater detail from FIGS. 1 and 2, the first direction as indicated by directional arrow 43 therefore corresponds to the z direction and the second direction as indicated by directional arrow 47 corresponds to the y direction of the system of coordinates.

Figure 4:
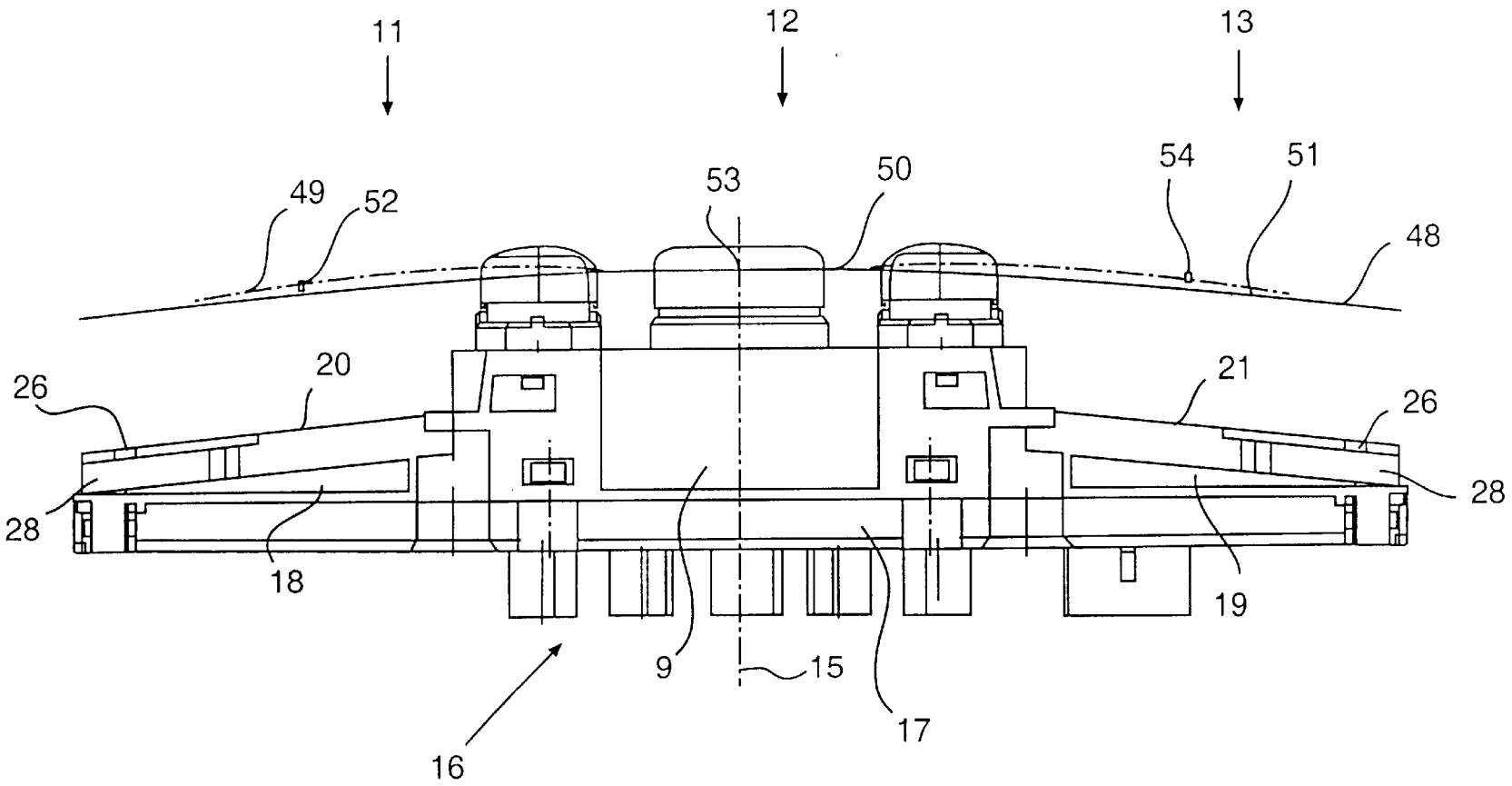
FIG. 4 is a side view as in FIG. 1 with the lateral housing parts omitted and the path of the mask shown schematically.

Furthermore, each of the housing parts 8, 9, and 10 is located approximately parallel to a plane surface that approximates the curvature of associated areas 11, 12, and 13, as is evident by jointly viewing FIGS. 1 and 4. For clarification, in FIG. 4 (in which only middle housing part 9 is shown, omitting lateral housing parts 8 and 10), the pattern of mask 48 is indicated by a solid line. Dashed lines are also used to show the approximating plane surfaces 49, 50, and 51. Approximating surface 49 is associated with area 11 for left lateral housing part 8, surface 50 is associated with area 12 for middle housing part 9, and surface 51 is associated with area 13 for right lateral housing part 10.

Approximating surfaces 49, 50, and 51 can be polygonal surfaces that are chosen to match the curvature of mask 6 and hence approach or approximate mask pattern 48. In particular, it is possible to choose as approximating surfaces 49, 50, 51, a tangential plane whose path matches the curvature of the corresponding areas 11, 12, 13, as shown in FIG. 4. The tangential plane is located at a suitably chosen point in respective areas 11, 12, 13, for example at their midpoints 52, 53, 54. The tangential plane of area 12 runs approximately in a horizontal direction and thus corresponds roughly to the x-y plane. The tangential planes for areas 11 and 13 each run at an angle thereto and symmetrically with respect to central axis 15, 15'.

Housing parts 8, 9, and 10 can be located on a supporting part 17. Because of the symmetry of mask 6 with respect to central axis 15, 15', it is possible in an improvement to integrate middle housing part 9 associated with area 12 into supporting part 17, with supporting part 17 being connected integrally with the housing part 9, for example by manufacture as a one-piece injection-molded part. Thus, supporting part 17 and housing part 9 together form a type of basic body 16, with sections 18, 19 of supporting part 17 located on each side. Housing parts 8 and 10 are located in sections 18 and 19 of supporting part 17. For this purpose, the parts of sections 18, 19 of supporting part 17 facing mask 6 are designed as areas 20, 21 that serve to receive housing parts 8, 10. These areas 20, 21 are already roughly parallel to approximating plane surfaces 49, 51 of areas 11, 13 of mask 6 associated with housing parts 8, 10.

Since areas 20, 21 run roughly parallel to approximating surfaces 49, 51 for areas 11, 13, housing parts 8, 10, are already largely correctly aligned when mounted on supporting part 17. However, to permit even more refined adjustment, housing parts 8 and 10 can be displaced relative to one another and/or to supporting part 17 and/or to basic body 16 in at least one direction. Displaceability of housing parts 8, 10 is provided in at least the first direction corresponding to the curvature of mask 6, and in this case simultaneously in the mounting direction, as indicated by directional arrow 43 for mounting of mask 6 on housing 4. As shown in FIG. 1, centering means 14 are located on mask 6, said means extending essentially in the first direction. These centering means 14 act on housing parts 8, 10 to align them when mask 6 is mounted on housing 4. As a result, the alignment of housing parts 8, 10 approximately parallel to approximating surfaces 49, 51 of corresponding areas 11, 13 can be further improved when mask 6 is mounted.

If mask 6 has another curvature that runs in the second direction corresponding to directional arrow 47, supporting part 17 is so designed that areas 20, 21 for receiving housing parts 8, 10 are already aligned roughly parallel to areas 55, 57 that approximate the curvature of areas 11, 13 in the second direction. In FIG. 2, areas 55, 56, 57 that approximate areas 11, 12, and 13 in the second direction as indicated by directional arrow 47 are again shown by dashed lines, while mask pattern 48' is shown by a solid line. In order to permit refinement of adjustment in this case as well, displaceability of housing parts 8 and 10 in the second direction can also be advantageous.

In an improvement on the invention, housing parts 8 and 10 can be mounted displaceably within a plane that runs parallel to approximating plane areas 49, 51 corresponding to the curvature of mask 6 in the first direction as indicated by directional arrow 43. To form the bearing, an arrangement designed in the form of a floating bearing on surfaces 20, 21 of supporting part 7 that serves to receive housing part 8, 10 is preferred. When mask 6 is applied, recesses 7 therein cooperate with actuating elements 3 located on housing parts 8, 10 so that housing parts 8, 10, because of the floating bearing, are displaced in such fashion that their positions are adjusted to the contour of mask 6. As a result, the alignment of housing parts 8 and 10 approximately parallel to approximating surfaces 55, 57, corresponding to the curvature of corresponding areas 11, 13 in the second direction as indicated by directional arrow 47, can be further improved when mounting mask 6.

Figure 7:
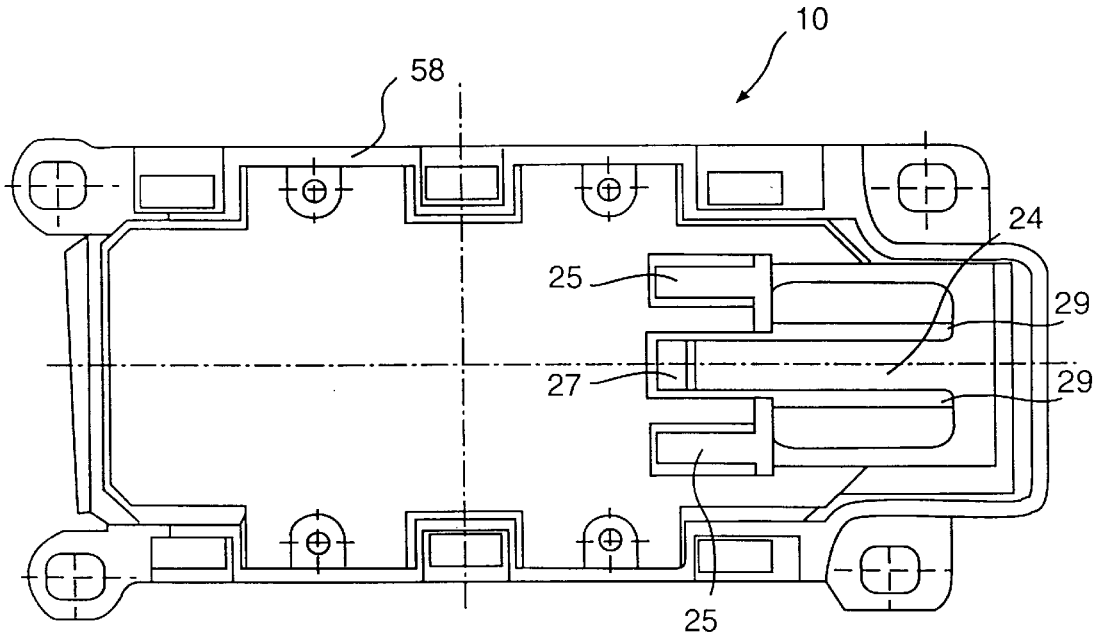
FIG. 7 is a bottom view of the housing part in FIG. 5.

Housing parts 8 and 10 can be mounted displaceably, so that they cooperate with supporting part 17 at sections 18, 19 by guides 22, 23 with corresponding play, as shown in FIG. 1. Guide 23 on housing part 8, 10 overlaps, by a wall 58 associated with section 18, 19, guide 22 designed as a surface in section 18, 19 of supporting part 17. The overlapping wall can also conversely be located on supporting part 17 and overlapping guide 23. In addition, the displaceability of housing parts 8, 10 is reinforced by a spring-loaded rib 24 (FIG. 7) which is located on the underside of housing parts 8, 10 facing sections 18, 19. For example, spring-loaded rib 24 can consist of a tongue formed by means of a free punch 29 on the underside of housing parts 8, 10.

Spring-loaded rib 24 has a latching nose 27 that engages a recess 26, shown in FIG. 4, in sections 18, 19 of supporting part 17, with corresponding play. Adjacent to spring-loaded rib 24 are two fixed ribs 25 on the underside of housing parts 8, 10, with the two fixed ribs 25 engaging a recess 28 (FIG. 4) on supporting part 17, likewise with corresponding play. Of course, conversely, the spring-loaded rib and the fixed rib as the supporting part as well as a recess and the receptacle can be located on housing parts 8, 10. Spring-loaded rib 24 guarantees elastic displaceability of housing parts 8, 10 in the first direction, with displaceability being determined by the play between fixed ribs 25 and receptacle 28. The play of latching noses 27 in recess 26 together with the play of guides 22, 23 determines the displaceability within the floating bearing of housing part 8, 10, especially in the second direction, which is also clear in conjunction with FIG. 7.

As has already been explained, when mask 6 is applied, because of their displaceability, housing parts 8 and 10 are automatically adjusted to the contour of mask 6. In order to secure housing parts 8, 10 in this assumed position, they are fastened to mask 6 after mask 6 has been applied. Fastening can be performed by screwing. Threaded bushings are provided on the side of mask 6 facing housing parts 8, 9, and 10 for screwing them together. Preferably, centering means 14 are simultaneously provided as threaded bushings on mask 6. Fastening screws 31 in turn engage the threaded bushings, and penetrate elongate holes 30 to housing parts 8, 9, and 10.

Switches 2 are preferably rocker switches, so that actuating element 3 is designed as a rocker 32. As can be seen in greater detail from switch 2, shown sectioned in switch group 2*b* in FIG. 1, rocker 32 is rotatably mounted on a frame 33. Switch 2 itself can consist of at least one switch module 34 that contains the contact system and is in the form of a pressure switch. Rocker 32 acts on switch module 34 through a compensating element 35 with cams, not shown in greater detail, for actuating the contact system. Switch modules 34 of this kind are known, for example, from German patent document DE-OS 42 16 454. Of course, another rocker switch can be used instead of switch module 34.

Figure 5:
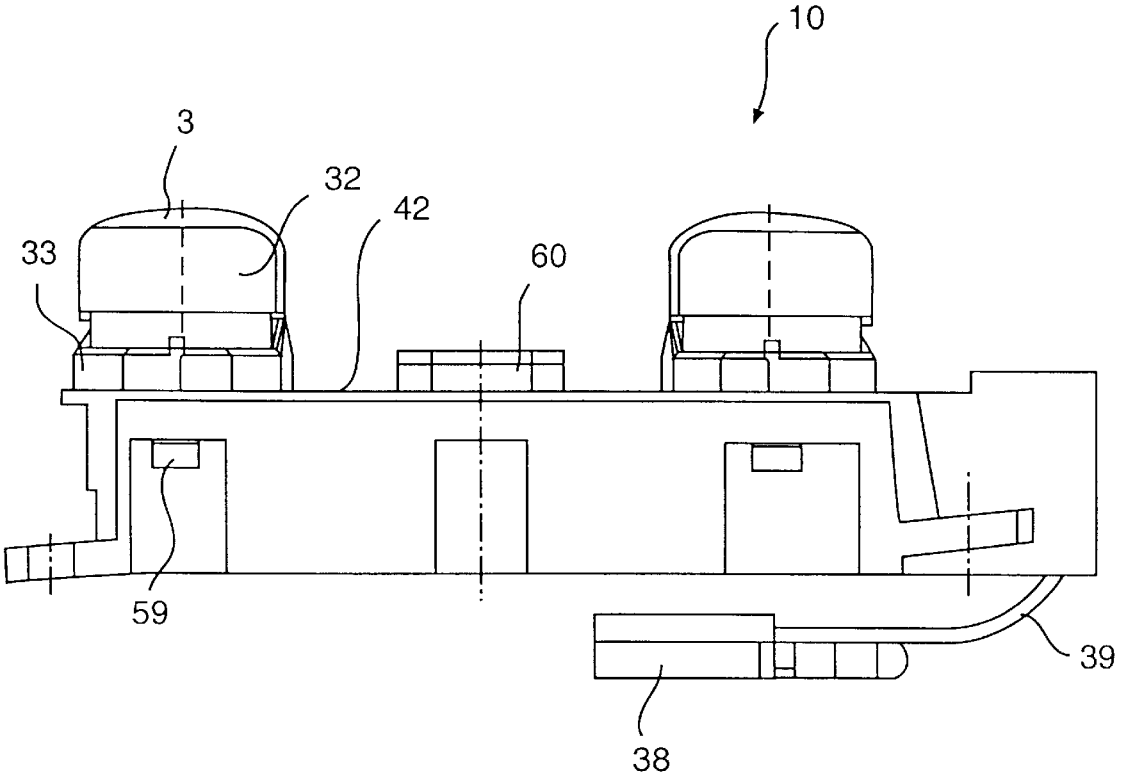
FIG. 5 is a side view of a single housing part as in FIG. 1.

Switch module 34 is mounted on a printed circuit board 36, with one printed circuit board 36 being located in housing part 8, 9, 10. For actuation of switch module 34 by actuating element 3, an opening 40 is provided for each switch 2 on the side of housing parts 8, 9, 10 facing mask 6. During preassembly, switch module 34 is mounted parallel to the mounting direction indicated, corresponding to directional arrow 43 on printed circuit board 36 in such fashion that it penetrates opening 40. In addition, the required electrical or electronic components 37 as well as plug-in connections 38 for electrical leads 39 (see FIG. 5) to switch module 34 are mounted on printed circuit board 36. Electronics not shown in greater detail can also be provided on printed circuit board 36 for incorporating switch arrangement 1 in a bus system, for example the CAN bus known of itself.

Figure 6:
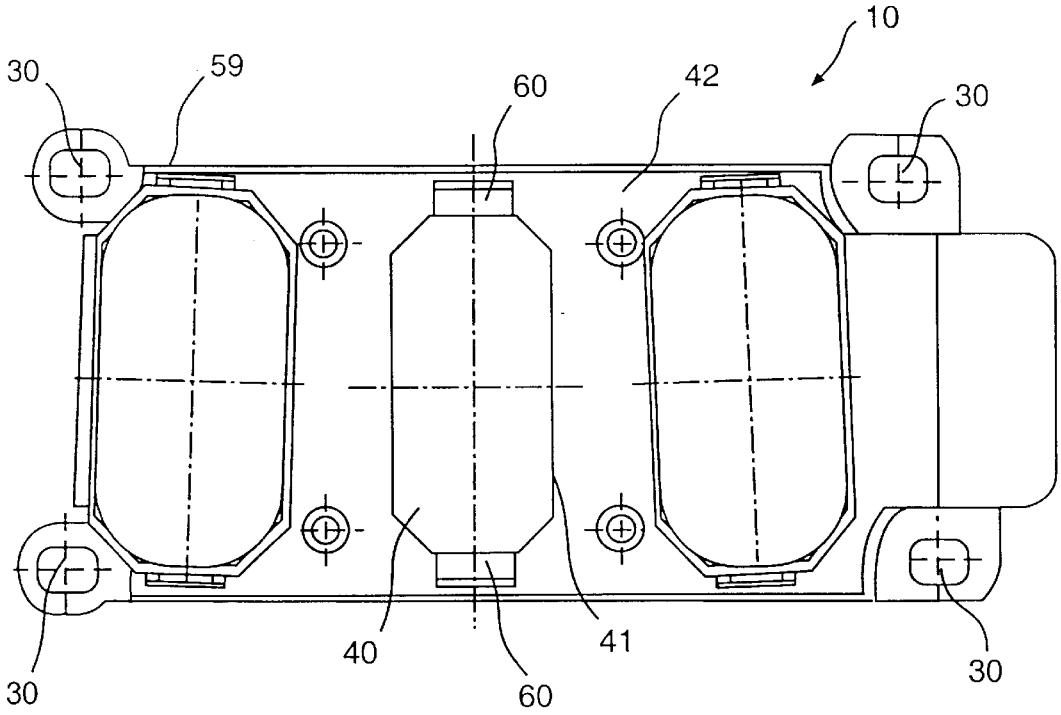
FIG. 6 is a top view of the housing part in FIG. 5.

Opening 40 is surrounded by a projecting edge 41 facing mask 6. Frame 33 for actuating element 3 is displaceable in the manner of a floating mount on surface 42 of housing parts 8, 9, 10 facing mask 6, with frame 33 surrounding edge 41 with play. As indicated in greater detail in FIGS. 5 and 6, guide noses 59 are provided for floating mounting on frame 33, said noses engaging matching guide slots 60 on housing parts 8, 9, 10. The displaceability of frame 33 on surface 42 on housing part 8, 9, 10 is provided by the play of guide noses 59 in guide slots 60 as well as the play of frame 33 around edge 41.

This floating mounting of frame 33 achieves improved separate adjustment and centering of actuating elements 3 of individual switches 2 in recess 7 during mounting of mask 6. The outer surfaces of frame 33 cooperate with the respective edges of a recess 7 so that frame 33 (and hence actuating element 3 mounted thereon) is centered in recess 7 during mounting of mask 6 on housing 4. Consequently, following final assembly, the formerly floating-mounted frame 33 on housing 4 is immovable and positioned centrally with respect to corresponding recess 7.

While the two lateral housing parts 8 and 10 are mounted displaceably on supporting part 17 in order to permit a refinement of adjustment, with a mask 6 that is curved symmetrically with respect to central axis 15, 15', central housing part 9 can be permanently mounted on the supporting part as already mentioned. Preferably a switch, especially switch 21 located on central axis 15, 15' of housing part 9, is made nondisplaceable while the other switches 2 of switch group 2*a* are displaceable by means of a floating mount for centering in recess 7. Hence, switch 2' serves as a reference for alignment of the two lateral housing parts 8 and 10 as well as the other switches 2 when mounting mask 6.

The invention is not limited to the embodiment described and shown. Rather, it also comprises all improvements made by individuals skilled in the art within the framework of the idea of the invention. Thus, push-button switches or the like can be used instead of toggle switches in the switch arrangement. In addition, the invention can be used not only in motor vehicles but also for control panels in household appliances, machinery, or the like.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Switch arrangement for a control panel in a motor vehicle, comprising:

at least one switch having at least one actuating element;

a housing, having a receptacle for the at least one switch; and a mask mountable on the housing, and having a recess through which the actuating element of the at least one switch projects following mounting of the mask; wherein:

a contour of the mask has a curvature;

the housing includes at least two housing parts, with each of the housing parts being associated with an area of the mask; and a side of each of the housing parts facing the mask is located approximately parallel to an approximating plane surface that approximates the curvature of the associated area of the mask.

2. The switch arrangement according to claim 1 wherein the control panel is arranged on one of a dashboard and a console of the motor vehicle.

3. The switch arrangement according to claim 1 wherein said at least one switch comprises at least one switch selected from among electrical, electrooptical, and optical switches.

4. The switch arrangement according to claim 1 wherein said plane surface lies in a tangential plane which approximates a curvature of the associated area of the mask.

5. Switch arrangement according to claim 1, wherein:

a surface of the actuating element runs approximately parallel to a surface that approximates the surroundings of the recess in the mask; and the contour of the mask has a curvature in a first direction that is approximately perpendicular to the surface of the actuating element, with a mounting direction for application of the mask to the housing coinciding with the first direction.

6. Switch arrangement according to claim 5 wherein the contour of the mask has a curvature in a second direction that is located approximately on the surface of the actuating element.

7. Switch arrangement according to claim 1 wherein:

at least one of the housing parts is located on a surface of a supporting part that is approximately parallel to the approximating plane surface of the associated area of the mask; and another one of the housing parts and the supporting part form a body in which the part can be connected in one piece with the another of the housing parts.

8. Switch arrangement according to claim 1 wherein:

the housing parts are displaceable relative to one another, to a supporting part or to a basic body, so that when mask is applied, the housing parts, for adaptation to the contour of the mask, are aligned approximately parallel to the approximating surface of the associated area of the mask, with the housing parts being displaceable in at least one direction that corresponds to the curvature of mask or a mounting direction for mounting the mask on the housing; and centering means are also located on the mask for aligning the housing parts when the mask is mounted on the housing.

9. Switch arrangement according to claim 1 wherein:

at least one of the housing parts is displaceably mounted within a plane that extends parallel to the associated approximating plane surface, corresponding to the curvature of the mask in first direction;

the switch arrangement comprises a floating bearing, on a surface of a supporting part that serves to receive the housing parts, whereby the housing parts are aligned approximately parallel to an the approximating plane surface corresponding to the curvature of the mask in a second direction when the mask is applied, by cooperation of a recess in the mask with the actuating element located on the housing parts, for adaptation to the contour of the mask.

10. Switch arrangement according to claim 9, wherein:

the housing parts and the supporting part cooperate with one another for displaceable mounting by means of guides with corresponding play;

a spring-loaded rib mounted on one of the housing parts and the supporting part preferably engages by means of a locking nose in a recess on another of the housing parts and the supporting part with corresponding play, and with a spring-loaded rib consisting of a tongue on a side of the one the housing parts associated with the another of the housing parts; and a fixed rib is located on one of the housing parts and the supporting part, the fixed rib engages a recess on another of the housing parts and the supporting part, with corresponding play.

11. Switch arrangement according to claim 1 wherein the housing parts are fastened to the mask following mounting of the mask, whereby the housing parts are secured in a position assumed when the mask is applied, fastened by a screw connection, with threaded bushings which serve simultaneously as centering means on the mask, said bushings being provided on a side of the mask that faces the housing parts, and with penetrating mounting screws engaging the threaded bushings through elongate holes on the housing parts.

12. Switch arrangement according to claim 1 wherein:

the at least one switch contains at least one switch module housing a contact system;

the at least one switch comprises a pressure switch, with the actuating element acting on the switch module to actuate the contact system;

a printed circuit board is located in the housing parts to receive the switch module;

the printed circuit board accepts at least electrical components and a plug connection for electrical leads to the switch module; and an opening is provided on a side of each of the housing parts facing the mask, through which opening the actuating element acts on the switch module.

13. Switch arrangement according to claim 1 wherein:

the actuating element is a rocker and is rotatably mounted on a frame;

the frame is mounted displaceably as a floating bearing on a surface of one of the housing parts facing the mask, with guide noses on the frame engaging corresponding guide slots on the one of the housing parts with play;

the opening is surrounded by a projecting edge facing the mask; and the frame for the actuating element surrounds an edge with play, whereby the frame cooperates with a recess in the mask for centering the actuating element in the recess when the mask is applied.

14. Switch arrangement according to claim 1 wherein:

the contour of the mask has curvatures symmetrical to a central axis running through the housing;

the housing comprises three housing parts, with a middle housing part preferably being rigidly integrated into a supporting part;

each of the housing parts is mounted displaceably on the supporting part; and a selected switch is also preferably nondisplaceably located on a central axis, whereby the selected switch serves as a reference for aligning the housing parts as well as for other switches when the mounting mask is applied.

15. Switch arrangement according to claim 14 wherein the selected switch actuates a vehicle flasher system.

* * * * *